US005726141A

United States Patent [19]

Ofosu-Asante

[11] Patent Number: 5,726,141

[45] Date of Patent: Mar. 10, 1998

[54] LOW SUDSING DETERGENT COMPOSITIONS CONTAINING LONG CHAIN AMINE OXIDE AND BRANCHED ALKYL CARBOXYLATES

[75] Inventor: Kofi Ofosu-Asante, Cincinnati, Ohio

[73] Assignee: The Procter & Gamble Company, Cincinnati, Ohio

[21] Appl. No.: 770,887

[22] Filed: Dec. 20, 1996

Related U.S. Application Data

[63] Continuation of Ser. No. 466,944, Jun. 6, 1995, abandoned, which is a continuation of Ser. No. 187,255, Jan. 25, 1994, abandoned.

[51] Int. Cl.[6] ..... C11D 1/83; C11D 3/386; C11D 10/04

[52] U.S. Cl. ..... 510/220; 510/221; 510/223; 510/226; 510/228; 510/229; 510/231; 510/421; 510/437; 510/491; 510/503; 510/509; 510/510

[58] Field of Search ..... 510/220, 221, 510/223, 226, 228, 229, 231, 421, 437, 491, 503, 509, 510

[56] References Cited

U.S. PATENT DOCUMENTS

| | | | |
|---|---|---|---|
| 3,844,951 | 10/1974 | Fries et al. | 252/8.6 |
| 4,144,201 | 3/1979 | Winterbotham et al. | 252/547 |
| 4,316,824 | 2/1982 | Pancheri | 252/551 |
| 4,561,998 | 12/1985 | Wertz et al. | 252/547 |
| 5,230,823 | 7/1993 | Wise et al. | 252/174.21 |
| 5,244,593 | 9/1993 | Roselle et al. | 252/99 |
| 5,269,974 | 12/1993 | Ofosu-Asante | 252/544 |
| 5,376,297 | 12/1994 | Choy et al. | 252/108 |
| 5,378,409 | 1/1995 | Ofosu-Asante | 252/548 |
| 5,415,801 | 5/1995 | Ofosu-Asante | 510/235 |
| 5,415,814 | 5/1995 | Ofosu-Asante et al. | 252/558 |
| 5,417,893 | 5/1995 | Ofosu-Asante et al. | 252/558 |
| 5,474,710 | 12/1995 | Ofosu-Asante et al. | 510/537 |
| 5,489,393 | 2/1996 | Connor et al. | 252/134 |
| 5,599,400 | 2/1997 | Mao et al. | 134/25.2 |
| 5,629,278 | 5/1997 | Baeck et al. | 510/236 |
| 5,679,630 | 10/1997 | Baeck et al. | 510/305 |

FOREIGN PATENT DOCUMENTS

| | | | |
|---|---|---|---|
| 1266200 | of 1989 | Japan | C11D 17/08 |
| 1301799 | 12/1989 | Japan | C11D 7/26 |
| 2245097 | 9/1990 | Japan | C11D 1/86 |
| 4323298 | 11/1992 | Japan | C11D 3/20 |
| 2 219 594 | 12/1989 | United Kingdom | C11D 1/94 |
| WO 95/05440 | 2/1995 | WIPO | C11D 1/75 |
| WO 95/07971 | 3/1995 | WIPO | C11D 3/386 |

*Primary Examiner*—Douglas J. McGinty
*Assistant Examiner*—Lorna M. Douyon
*Attorney, Agent, or Firm*—Ken K. Patel; Kim W. Zerby; Jacobus C. Rasser

[57] ABSTRACT

Low sudsing dishwashing detergent compositions which exhibit good grease emulsification performance comprise branched alkyl carboxylate detergent surfactants and long chain amine oxide. A preferred embodiment contains anionic or nonionic co-surfactants.

4 Claims, No Drawings

LOW SUDSING DETERGENT COMPOSITIONS CONTAINING LONG CHAIN AMINE OXIDE AND BRANCHED ALKYL CARBOXYLATES

This is a continuation of application Ser. No. 08/466,944, filed on Jun. 6, 1995, now abandoned, which is a continuation of Ser. No. 08/187,255, filed on Jan. 25, 1994, now abandoned.

TECHNICAL FIELD

The present invention relates to detergent compositions containing branched alkyl carboxylate surfactants and long chain amine oxides for low sudsing compositions with improved grease emulsification.

BACKGROUND OF THE INVENTION

Dishwashing detergent compositions are well known in the art. However, the removal of greasy food residues from dishware in dishwashing operations has become a particular challenge to the formulator. Modern dishwashing compositions are, in the main, formulated as aqueous liquids; accordingly, water-stable ingredients must be used. Moreover, in the case of hand dishwashing composition such compositions come into prolonged contact with skin; therefore, they must be mild. Yet, mildness is difficult to achieve in an effective dishwashing product, since products which remove grease from dishware may also tend to remove the natural skin oils from the user's hands.

Various means are employed to enhance grease and oil removal performance of detergent compositions. Grease-cutting nonionic surfactants have been employed, but some of these may be irritating to biological membranes. Attempts have been made to employ nonconventional detergent surfactants in liquid compositions. Indeed, while a review of the literature would seem to suggest that a wide selection of surfactants is available to the detergent manufacturer, the reality is that many such materials are specialty chemicals which are not suitable in low unit cost items such as home-use detergent compositions. The fact remains that most home-use detergents still comprise one or more of the conventional ethoxylated nonionic and sulfated or sulfonated anionic surfactants, presumably due to economic considerations.

The challenge to the detergent manufacturer seeking improved grease/oil removal has been increased by various environmental factors. For example, some nonbiodegradable ingredients have fallen into disfavor. Effective phosphate builders have been banned by legislation in many countries. Moreover, many surfactants are often available only from nonrenewable resources such as petrochemicals. Accordingly, the detergent formulator is quite limited in the selection of surfactants which are effective cleaners, biodegradable and, to the extent possible, available from renewable resources such as natural fats and oils, rather than petrochemicals.

Considerable attention has lately been directed to nonionic surfactants which can be prepared using mainly renewable resources, such as fatty esters and sugars. One such class of surfactants includes the polyhydroxy fatty acid amides. Moreover, the combination of such nonionic surfactants with alkyl sulfates, alkyl benzene sulfonates, alkyl ether sulfates, branched alkyl carboxylates (i.e. secondary soaps) and the like has also been studied. The present invention undertakes to substantially improve the grease and oil removal properties of branched alkyl carboxylate compositions.

Succinctly stated, the invention herein is based on the unexpected discovery that use of long chain amine oxides inhibit sudsing and substantially enhance the grease and oil removal properties of detergent compositions containing branched alkyl carboxylate surfactants. While not intending to be limited by theory, it appears that inclusion of such amine oxides into such compositions substantially enhances their ability to rapidly lower the interfacial tension of aqueous washing liquors with greasy and oil soils. This substantial reduction of interfacial tension leads to what might be termed "spontaneous emulsification" of greasy and oil soils, thereby speeding their removal from soiled surfaces and inhibiting the redeposition of the soils onto substrates.

It has further been determined that the use of long chain amine oxides at particular levels does not provide optimum high sudsing needed for most manual dishwashing detergent compositions but rather inhibits sudsing. Indeed, short chain amine oxides and/or anionic surfactants are often conventionally used to increase suds levels in typical light duty liquid or gel dishwashing detergent compositions. The consumer in certain regions tends to equate performance of hand dishwashing products with suds height and volume, and even uses the diminution of suds to signal the need for the addition of more product into the dishwash bath. However, some geographies such as Asia, do not prefer high sudsing hand dishwashing compositions. In addition high sudsing is detrimental in the overall performance of automatic dishwashing detergent and laundry.

By the present invention it has been determined that certain levels of long chain amine oxides not only provide the desired lowering of interfacial tension, with its attendant increase in grease removal performance, but also allow the formulation of reasonably low sudsing detergent compositions which are stable and homogeneous. It has further been discovered that these special benefits can be achieved at a broad pH range, especially neutral pH which enhances mildness in hand dishwashing compositions. The overall unexpected improvements in performance and aesthetic qualities, especially grease emulsification in a variety of detergent formulations, provide the basis for the present invention, which is described in more detail hereinafter.

SUMMARY OF THE INVENTION

The present invention relates to a low sudsing, grease emulsification detergent composition comprising by weight:

(a) from about 0.1% to about 99% of branched alkyl carboxylate detergent surfactant selected from the group consisting of $C_{12-16}$ alkyl ethoxy carboxylates; $C_{11-20}$ specially selected secondary soaps; and mixtures thereof; and (b) from about 0.1% to about 40% $C_{10}$–$C_{22}$ amine oxide; said composition having a pH between about 6 to about 13.

A particularly preferred embodiment also comprises from about 1% to about 50% anionic and/or nonionic co-surfactant and 0.1% to about 4% divalent ions (i.e. magnesium and/or calcium).

DETAILED DESCRIPTION OF THE INVENTION

The dishwashing detergent compositions of the present invention contain two essential components:

(1) branched alkyl carboxylate detergent surfactants; and (2) $C_{10}$ to $C_{22}$ amine oxide.

Optional ingredients, especially anionic and/or nonionic co-surfactants, can be added to provide various performance and aesthetic characteristics.

The term "light-duty dishwashing detergent composition" as used herein refers to those compositions which are employed in manual (i.e. hand) dishwashing.

Branched Alkyl Carboxylate Suffactant

The compositions of this invention contain from about 0.1% to about 99%, preferably from about 10% to about 70%, most preferably from about 20% to about 60% of branched alkyl carboxylate surfactant.

Alkyl ethoxy carboxylates of the generic formula $$RO(CH_2CH_2O)_xCH_2COO^-M^+$$

wherein R is a $C_{12}$ to $C_{16}$ alkyl group x ranges from about 3 to about 10, preferably about 4 to about 10, and the ethoxylate distribution is such that, on a weight basis, the amount of material where x is 0 is less than about 20%, preferably less than about 15%, most preferably less than about 10%, and the mount of material where x is greater than 7 is less than about 25%, preferably less than about 15%, most preferably less than about 10%, the average x is from about 2 to 4 when the average R is $C_{13}$ or less, and the average x is from about 3 to 6 when the average R is greater than $C_{13}$, and M is a cation preferably chosen from alkali metal, ammonium, mono-, di-, and tri-ethanolammonium, most preferably from sodium, potassium, ammonium, and mixtures thereof. The preferred alkyl ethoxy carboxylates are those where R is a $C_{12}$ to $C_{14}$ alkyl group.

"SPECIALLY SELECTED SECONDARY SOAPS"

The term "specially selected soaps" (aka "alkyl carboxyl surfactants") herein does not encompass the classic, conventional water-soluble salts of $C_{10}$–$C_{18}$ linear saturated and unsaturated fatty acids. Compositions according to the present invention containing such water-soluble special soaps exhibit quite low interfacial tensions, and good grease removal properties, even at pH's near neutrality, i.e., in the range of ca. 6.5–9.0. As a general proposition, the improved qualities of the compositions herein appear to peak with such special soaps which are about $C_{12}$–$C_{13}$, and decrease somewhat with special soaps which contain more than about 14 carbon atoms or less than about 11 carbon atoms, especially with respect to spontaneous emulsification of greasy soils. Accordingly, the $C_{12}$–$C_{13}$ special soaps are preferred herein. (The aforesaid C numbers are intended to include the total carbon number including the carboxylate carbon atom in the special soaps.) These soaps can be employed in any water-soluble salt form, e.g., alkali metal, alkaline earth metals ammonium, alkanolammonium, dialkanol ammonium, trialkanol ammonium, 1–5 carbon alkyl substituted ammonium, basic amino acid groups, and the like; all of these counterions are well-known to manufacturers. The sodium salt form is convenient, cheap and effective. The acid form can also be used, but will usually be converted into the ionic form by pH adjustments which are made during processing of the compositions.

The specially selected secondary soaps employed herein to provide additional low interfacial tension, and spontaneous emulsification of grease are those which contain a carboxyl unit connected to a secondary carbon. It is to be understood herein that the secondary carbon can be in a ring structure, e.g., as in p-octyl benzoic acid, or as in alkyl-substituted cyclohexyl carboxylates. The special soaps should contain no ether linkages, no ester linkages and no hydroxyl groups. There should be no nitrogen atoms in the head-group (amphiphilic portion). The special soaps usually contain 11–14 total carbon atoms, although slightly more (e.g., about 14–16) are preferred if the soap contains a ring structure, as noted above, e.g., p-octyl benzoic acid.

For purposes of illustration, and not by way of limitation, the special soaps based on the following secondary fatty acids produce low interfacial tension and spontaneous emulsification when used in the manner of this invention: 2-methyl-1-undecanoic acid; 2-ethyl-1-decanoic acid; 2-propyl-1-nonanoic acid; 2-butyl-1-octanoic acid; 2-pentyl-1-heptanoic acid; 2-methyl-1-dodecanoic acid; 2-ethyl-1-undecanoic acid; 2-propyl-1-decanoic acid; 2-butyl-1-nonanoic acid; 2-pentyl-1-octanoic acid; p-octyl benzoic acid; and trans-4-pentylcyclohexane carboxylic acid. By contrast, and to illustrate the importance of a α-carbon substitution, chain length, and the like, the following carboxyls do not provide the desirable spontaneous emulsification effect herein: p-nonyloxy benzoic acid; 2-heptyl undecanoic acid; 12-hydroxy dodecanoic acid; and 2-hydroxy lauric acid.

The following general structures further illustrate some of the special soaps (or their precursor acids) employed in this invention.

A. A highly preferred class of soaps used herein comprises the $C_{10}$–$C_{16}$ secondary carboxyl materials of the formula $R^3CH(R^4)COOM$, wherein $R^3$ is $CH_3(CH_2)_x$ and $R^4$ is $CH_3(CH_2)_y$, wherein y can be 0 or an integer from 1 to 6, x is an integer from 6 to 12 and the sum of (x+y) is 6–12, preferably 7–11, most preferably 8–9.

B. Another class of special soaps useful herein comprises those carboxyl compounds wherein the carboxyl substituent is a ring hydrocarbyl unit, i.e., secondary soaps of the formula $R^5$—$R^6$—COOM, wherein $R^5$ is $C_7$–$C_{10}$, preferably $C_8$–$C_9$, alkyl or alkenyl and $R^6$ is a ring structure, such as benzene, cyclopentane, cyclohexane, and the like. (Note: $R^5$ can be in the ortho, meta or para position relative to the carboxyl on the ring.)

C. Still another class of soaps includes the $C_{10}$–$C_{18}$ primary and secondary carboxyl compounds of the formula $R^7CH(R^8)COOM$, wherein the sum of the carbons in $R^7$ and $R^8$ is 8–16, $R^7$ is of the form $CH_3$—$(CHR^9)_x$ and $R^8$ is of the form H—$(CHR^9)_y$, where x and y are integers in the range 0–15 and $R^9$ is H or a $C_{1-4}$ linear or branched alkyl group. $R^9$ can be any combination of H and $C_{1-4}$ linear or branched alkyl group members within a single —$(CHR^9)_{x,y}$ group; however, each molecule in this class must contain at least one $R^9$ that is not H. These types of molecules can be made by numerous methods, e.g. by hydroformylation and oxidation of branched olefins, hydroxyearboxylation of branched olefins, oxidation of the products of Guerbet reaction involving branched oxoalcohols. The branched olefins can be derived by oligomerization of shorter olefins, e.g. butene, isobutylene, branched hexene, propylene and pentene.

D. Yet another class of soaps includes the $C_{10}$–$C_{18}$ tertiary carboxyl compounds, e.g., neo-acids, of the formula $R^{10}CR^{11}(R^2)COOM$, wherein the sum of the carbons in $R^{10}$, $R^{11}$ and $R^{12}$ is 8–16. $R^{10}$, $R^{11}$, and $R^{12}$ are of the form $CH_3$—$(CHR^{13})_x$, where x is an integer in the range 0–13, and $R^{13}$ is H or a $C_{1-4}$ linear or branched alkyl group. Note that $R^{13}$ can be any combination of H and $C_{1-4}$ linear or branched alkyl group members within a single —$(CHR^{13})$ group. These types of molecules result from addition of a carboxyl group to a branched olefin, e.g., by the Koch reaction. Commercial examples include the neodecanoic acid manufactured by Exxon, and the Versatic™ acids manufactured by Shell. In each of the above formulas A, B, C and D, the species M can be any suitable, especially water-solubilizing, counterion, e.g., H, alkali metal, alkaline earth metal, ammonium, alkanolammonium, di- and tri- alkanolammonium, $C_1$–$C_5$ alkyl substituted ammonium and the like. Sodium is convenient, as is diethanolammonium.

Formula C class soaps comprise secondary carboxyl compounds of the formula $CH_3(CHR)_k$—$(CH_2)_m$—$(CHR)_n$—$CH(COOM)(CHR)_o$—$(CH_2)_p$—$(CHR)_q$—$CH_3$, wherein each R is $C_1$–$C_4$ alkyl, wherein k, n, o, q are integers in the range of 0–2 and m and p are integers in the range of 0–8, provided that the total number of carbon atoms (including the carboxylate) is in the range of 10 to 18.

Preferred secondary special soaps for use herein are water-soluble members selected from the group consisting of the water-soluble salts of 2-methyl-1-undecanoic acid, 2-ethyl-1-decanoic acid, 2-propyl-1-nonanoic acid, 2-butyl-1-octanoic acid; 2-pentyl-1-heptanoic acid; 2-methyl-1-dodecanoic acid; 2-ethyl-1-undecanoic acid; 2-propyl-1-decanoic acid; 2-butyl-1-nonanoic acid; 2-pentyl-1-octanoic acid and mixtures thereof.

In a preferred embodiment the secondary soap is selected on the basis of product odor both in neat form and dilute aqueous solutions. Secondary soaps of the formula $R^3CH(R^4)COOM$ in which the total carbon number is constant, odor improves as the length of the shorter alkyl chain ($R^4$) increases, e.g. 2-butyl-1-octanoic acid is preferred over 2-methyl-1-undecanoic acid. Similarly, secondary soaps in which $R^4$ is a fixed carbon number, the odor improves as the total carbon increases (i.e. $R^3$ increases). For example, 2-methyl-1-dodecanoic acid is preferred over 2-methyl-1-undecanoic acid.

Secondary soaps can also be selected for their viscosity effect on the fully formulated product. For example, secondary soaps of the form $R^3CH(R^4)COOM$ in which the total carbon number is constant, the product viscosity decreases as $R^4$ carbon number increases. For example, 2-butyl-1-octanoic acid produces a lower viscosity than 2-methyl-1-undecanoic acid. If $R^4$ is constant, the viscosity increases with an increase in total carbon number. Thus, 2-methyl-1-dodecanoic would yield a higher product viscosity than 2-methyl-1-undecanoic acid.

Preferred light duty liquid or gel dishwashing detergent and laundry detergent compositions comprise from about 2% to about 10% of an branched alkyl carboxylate surfactant. Preferred automatic dishwashing detergent compositions comprise from about 0.1% to about 4% branched alkyl carboxylate surfactant.

Long Chain Amine Oxide

The long chain amine oxide semi-polar nonionic surfactants of the present invention comprise compounds and mixtures of compounds having the formula:

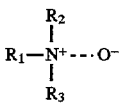

The above amine oxides are more fully described in U.S. Pat. Nos. 4,316,824 (Pancheri), 5,075,501 and 5,071,594, incorporated herein by reference.

The present invention contain from about 0.1% to about 40%, preferably from about 0.3% to about 30%, more preferably from about 0.5% to about 25% by weight of the long chain amine oxide. Preferred light duty liquid or gel dishwashing detergent or laundry detergent compositions comprise from about 18% to about 30% amine oxide, whereas preferred automatic dishwashing detergent compositions comprise from about 0.5% to about 10% amine oxide.

CO-SURFACTANTS

Co-surfactants can be added for additional cleaning benefits. Included in this category are several anionic surfactants commonly used in liquid or gel dishwashing detergents. The cations associated with these anionic surfactants are preferably selected from the group consisting of calcium, sodium, potassium, magnesium, ammonium or alkanol-ammonium, and mixtures thereof, preferably sodium, ammonium, calcium and magnesium and/or mixtures thereof. Examples of anionic surfactants that are useful in the present invention are the following:

(1) Alkyl benzene sulfonates in which the alkyl group contains from 9 to 15 carbon atoms, preferably 11 to 14 carbon atoms in straight chain or branched chain configuration. An especially preferred linear alkyl benzene sulfonate contains about 12 carbon atoms. U.S. Pat. Nos. 2,220,099 and 2,477,383 describe these surfactants in detail.

(2) Alkyl sulfates obtained by sulfating an alcohol having 8 to 22 carbon atoms, preferably 12 to 16 carbon atoms. The alkyl sulfates have the formula $ROSO_3^-M^+$ where $R_{8-22}$ is the C alkyl group and M is a mono- and/or divalent cation.

(3) Paraffin sulfonates having 8 to 22 carbon atoms, preferably 12 to 16 carbon atoms, in the alkyl moiety. These surfactants are commercially available as Hostapur SAS from Hoechst Celanese.

(4) Olefin sulfonates having 8 to 22 carbon atoms, preferably 12 to 16 carbon atoms. U.S. Pat. No. 3,332,880 contains a description of suitable olefin sulfonates.

(5) Alkyl ether sulfates derived from ethoxylating an alcohol having 8 to 22 carbon atoms, preferably 12 to 16 carbon atoms, less than 30, preferably less than 12, moles of ethylene oxide. The alkyl ether sulfates having the formula:

$$RO(C_2H_4O)_xSO_3^-M^+$$

where R is the $C_{8-22}$ alkyl group x is 1–30 and M is a mono- or divalent cation.

(6) Alkyl glyceryl ether sulfonates having 8 to 22 carbon atoms, preferably 12 to 16 carbon atoms, in the alkyl moiety.

(7) Fatty acid ester sulfonates of the formula:

$$R_1—CH(SO_3^-M^+)CO_2R_2$$

wherein $R_1$ is straight or branched alkyl from about $C_8$ to $C_{18}$, preferably $C_{12}$ to $C_{16}$, and $R_2$ is straight or branched alkyl from about $C_1$ to $C_6$, preferably primarily $C_1$, and $M^+$ represents a mono- or divalent cation.

(8) Secondary alcohol sulfates having 6 to 18 carbon atoms, preferably 8 to 16 carbon atoms.

(9) Mixtures thereof.

The above described anionic surfactants are all available commercially. It should be noted that although both dialkyl sulfosuccinates and fatty acid ester sulfonates will function well at neutral to slightly alkaline pH, they will not be chemically stable in a composition with pH much greater than about 8.5.

Zwitterionic surfactants include derivatives of aliphatic quaternary ammonium, phosphonium, and sulphonium compounds in which the aliphatic moiety can be straight or branched chain and wherein one of the aliphatic substituents contains from about 8 to 24 carbon atoms and one contains an anionic water-solubilizing group. Particularly preferred zwitterionic materials are the ethoxylated ammonium sulfonates and sulfates disclosed in U.S. Pats. Nos. 3,925,262, Laughlin et al, issued Dec. 9, 1975 and 3,929,262, Laughlin et al, issued Dec. 30, 1975, said patents being incorporated herein by reference.

Ampholytic surfactants include derivatives of aliphatic or heterocyclic secondary and ternary amines in which the aliphatic moiety can be straight chain or branched and wherein one of the aliphatic substituents contains from about 8 to about 24 carbon atoms and at least one aliphatic substituent contains an anionic water-solubilizing group.

The composition of this invention can contain betaine detergent surfactants having the general formula:

$$R—N^+(R^1)_2—R^2COO^-$$

wherein R is a hydrophobic group selected from the group consisting of alkyl groups containing from about 10 to about 22 carbon atoms, preferably from about 12 to about 18 carbon atoms, alkyl aryl and aryl alkyl groups containing a similar number of carbon atoms with a benzene ring being treated as equivalent to about 2 carbon atoms, and similar structures interrupted by amido or ether linkages; each $R^1$ is an alkyl group containing from 1 to about 3 carbon atoms; and $R^2$ is an alkylene group containing from 1 to about 6 carbon atoms.

Examples of preferred betaines are dodecyl dimethyl betaine, cetyl dimethyl betaine, dodecyl amidopropyldimethyl betaine, tetradecyldimethyl betaine, tetradecylamidopropyldimethyl betaine, and dodecyldimethylammonium hexanoate.

Other suitable amidoalkylbetaines are disclosed in U.S. Pat. Nos. 3,950,417; 4,137,191; and 4,375,421; and British Patent GB No. 2,103,236, all of which are incorporated herein by reference.

It will be recognized that the alkyl (and acyl) groups for the above betaine surfactants can be derived from either natural or synthetic sources, e.g., they can be derived from naturally occurring fatty acids; olefins such as those prepared by Ziegler, or Oxo processes; or from olefins separated from petroleum either with or without "cracking".

The sultaines useful in the present invention are those compounds having the formula $(R(R^1)_2N^+R^2SO_3—$, wherein R is a $C_6$–$C_{18}$, hydrocarbyl group, preferably a $C_{10}$–$C_{16}$ alkyl group, more preferably a $C_{12}$–$C_{13}$ alkyl group, each $R^1$ is typically $C_1$–$C_3$ alkyl, preferably methyl, and $R^2$ is a $C_1$–$C_6$ hydrocarbyl group, preferably a $C_1$–$C_3$ alkylene or preferably hydroxyalkylene group. Examples of suitable sultaines include $C_{12}$–$C_{14}$ dimethylammonio-2-hydroxypropyl sulfonate, $C_{12-14}$ amido propyl ammonio-2-hydroxypropyl sultaine, $C_{12-14}$ dihydroxyethylammonio propane sulfonate, and $C_{16-18}$ dimethylammomo hexane sulfonate, with $C_{12-14}$ amido propyl ammomo-2-hydroxypropyl sultaine being preferred.

The complex betaines for use herein have the formula:

$$R—(A)_n—\{\underset{\underset{B}{|}}{N}—(CHR_1)_x\}_y—\underset{\underset{B}{|}}{N}—Q \qquad (I)$$

wherein R is a hydrocarbon group having from 7 to 22 carbon atoms, A is the group (C(O), n is 0 or 1, $R_1$ is hydrogen or a lower alkyl group, x is 2 or 3, y is an integer of 0 to 4, Q is the group $—R_2COOM$ wherein $R_2$ is an alkylene group having from 1 to 6 carbon atoms and M is hydrogen or an ion from the groups alkali metals, alkaline earth metals, ammonium and substituted ammonium and B is hydrogen or a group Q as defined.

An example of this category is alkylamphopolycarboxy glycinate of the formula:

$$R—\underset{\underset{CH_2COONa}{|}}{N}—CH_2CH_2CH_2—\underset{\underset{CH_2COONa}{|}}{N}—CH_2CH_2CH_2\underset{\underset{CH_2COONa}{|}}{N}—CH_2CH_2CH_2\underset{\underset{CH_2CO_2Na}{|}}{N}—CH_2CH_2Na$$

The composition of this invention can also contain certain cationic quaternary ammonium surfactants of the formula:

$$[R^1(OR^2)_y][R^3(OR^2)_y]_2R^4N^+X^-$$

or amine surfactants of the formula:

$$[R^1(OR^2)_y][R^3(OR^2)_y]R^4N$$

wherein $R^1$ is an y or alkyl benzyl group having from about 6 to about 16 carbon atoms in the alkyl chain; each $R^2$ is selected from the group consisting of $—CH_2CH_2—$, $—CH_2CH(CH_3)—$, $—CH_2CH(CH_2OH)—$, $—CH_2CH_2CH_2—$, and mixtures thereof; each $R^3$ is selected from the group consisting of $C_1$–$C_4$ alkyl, $C_1$–$C_4$ hydroxyalkyl benzyl and hydrogen when y is not 0; $R^4$ is the same as $R^3$ or is an alkyl chain wherein the total number of carbon atoms of $R^1$ plus $R^4$ is from about 8 to about 16; each y is from 0 to about 10, and the sum of the y values is from 0 to about 15; and X is any compatible anion.

Preferred of the above are the alkyl quaternary ammonium surfactants, especially the mono-long chain alkyl surfactant described in the above formula when $R^4$ is selected from the same groups as $R^3$. The most preferred quaternary ammonium surfactants are the chloride, bromide, and methylsulfate $C_{8-16}$ alkyl trimethylammonium salts, $C_{8-16}$ alkyl di(hydroxyethyl)methylammomum salts, the $C_{8-16}$ alkyl hydroxyethyldimethylammonium salts, $C_{8-16}$ alkyloxypropyl trimethylammonium salts, and the $C_{8-16}$ alkyloxypropyl dihydroxyethylmethylammonium salts. Of the above, the $C_{10-14}$ alkyl trimethylammonium salts are preferred, e.g., decyl trimethylammonium methylsulfate, lauryl trimethylammonium chloride, myristyl trimethylammonium bromide and coconut trimethylammonium chloride, and methylsulfate.

Suitable nonionic surfactants may be present in a variety of detergent formulations. For example, automatic dishwashing detergent compositions and laundry detergents comprise nonionic surfactants which do not foam. Even fight duty liquid dishwashing detergent compositions can contain from about 0.01% to about 15%, preferably from about 0.1% to about 10%, by weight nonionic detergent surfactants which do not foam and may even inhibit foaming. Suitable nonionic detergents are disclosed in U.S. Pat. No. 4,321,165, Smith et al (Mar. 23, 1982) U.S. Pat. No. 4,316,824 Pancheri (Feb. 234, 1982) and U.S. Pat. No. 3,929,678, Laughlin et al., (Dec. 30, 1975). Exemplary, non-limiting classes of useful nonionic surfactants are listed below.

1. The polyethylene, polypropylene, and polybutylene oxide condensates of alkyl phenols. In general, the polyethylene oxide condensates are preferred. These compounds include the condensation products of alkyl phenols having an alkyl group containing from 6 to 12 carbon atoms in either a straight- or branched-chain configuration with the alkylene oxide. Commercially available nonionic surfactants of this type include Igepal™ CO-630, marketed by the GAF Corporation; and Triton™ X-45, X-114, X-100, and X-102, all marketed by the Rohm & Haas Company.

2. The condensation products of aliphatic alcohols with from about 1 to about 25 moles of ethylene oxide. The alkyl chain of the aliphatic alcohol can either be straight or branched, primary or secondary, and generally contains from 8 to 22 carbon atoms. Particularly preferred are the condensation products of alcohols having an alkyl group containing from about 10 to about 20 carbon atoms with from about 2 to about 10 moles of ethylene oxide per mole of alcohol.

3. The condensation products of ethylene oxide with a hydrophobic base formed by the condensation of propylene oxide with propylene glycol. The hydrophobic portion of these compounds preferably has a molecular weight of from about 1500 to about 1800 and exhibits water insolubility.

4. The condensation products of ethylene oxide with the product resulting from the reaction of propylene oxide and ethylenediamine.

5. Alkylpolysaccharides disclosed in U.S. Pat. No. 4,565,647, Llenado, issued Jan. 21, 1986, having a hydrophobic group containing from about 6 to about 30 carbon atoms, preferably from about 10 to about 16 carbon atoms and a polysaccharide, e.g., a polyglycoside, hydrophilic group containing from about 1.3 to about 10, preferably from about 1.3 to about 3, most preferably from about 1.3 to about 2.7 saccharide units. U.S. Pat. Nos. 4,373,203 and 4,732,704, incorporated herein by reference, also describe acceptable surfactants.

6. Examples of the amide surfactants useful herein include the ammonia, monoethanol, and diethanoi amides of fatty acids having an acyl moiety containing from about 8 to about 18 carbon atoms and represented by the general formula:

$$R_1—CO—N(H)_{m-1}(R_2OH)_{3-m}$$

wherein $R_1$ is a saturated or unsaturated, aliphatic hydrocarbon radical having from about 7 to 21, preferably from about 11 to 17 carbon atoms; $R_2$ represents a methylene or ethylene group; and m is 1, 2, or 3, preferably 1. Specific examples of said amides are mono-ethanol amine coconut fatty acid amide and diethanoi amine dodecyl fatty acid amide. These acyl moieties may be derived from naturally occurring glycerides, e.g., coconut oil, palm oil, soybean oil, and tallow, but can be derived synthetically, e.g., by the oxidation of petroleum or by hydrogenation of carbon monoxide by the Fischer-Tropseh process. The monoethanol amides and diethanolamides of $C_{12-14}$ fatty acids are preferred.

7. Amine oxide semi-polar nonionic surfactants which have not been discovered to contribute to grease emulsification, however are useful as suds boosters, comprise compounds and mixtures of compounds having the formula:

$$R_1—(C_2H_4O)_n\overset{|}{\underset{|}{N^+}}\cdots O^-$$
$$R_3$$

wherein $R_1$ is an alkyl, 2-hydroxyalkyl, 3-hydroxyallcyl, or 3-alkoxy-2-hydroxypropyl radical in which the alkyl and alkoxy, respectively, contain from about 8 to about 18 carbon atoms, $R_2$ and $R_3$ are each propyl, isopropyl, 2-hydroxyethyl, 2-hydroxypropyl, or 3-hydroxypropyl, and n is from 0 to about 10.

8. Other useful surfactants for use in the compositions are the nonionic fatty alkylpolyglucosides. These surfactants contain straight chain or branched chain $C_8$ to $C_{15}$, preferably from about $C_{12}$ to $C_{14}$, alkyl groups and have an average of from about 1 to 5 glucose units, with an average of 1 to 2 glucose units being most preferred. U.S. Pat. Nos. 4,393,203 and 4,732,704, incorporated by reference, describe these surfactants.

9. The compositions hereof may also contain a polyhydroxy fatty acid amide surfactant of the structural formula:

$$R^2—\overset{O}{\overset{||}{C}}—\overset{R^1}{\overset{|}{N}}—Z$$

wherein: R is H, $C_1$–$C_4$ hydrocarbyl, 2-hydroxy ethyl, 2-hydroxy propyl, or a mixture thereof, preferably $C_1$–$C_4$ alkyl, more preferably $C_1$ or $C_2$ alkyl, most preferably $C_1$ alkyl (i.e. methyl); and $R^2$ is a $C_5$–$C_{31}$ hydrocarbyl preferably straight chain $C_7$–$C_{19}$ alkyl or alkenyl more preferably straight chain $C_9$–$C_{17}$ alkyl or alkenyl most preferably straight chain $C_{11}$–$C_{17}$ alkyl or alkenyl, or mixtures thereof; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z preferably will be derived from a reducing sugar in a reductive amination reaction; more preferably Z is a glycityl. Suitable reducing sugars include glucose, fructose, maltose, lactose, galactose, mannose, and xylose. As raw materials, high dextrose corn syrup, high fructose corn syrup, and high maltose corn syrup can be utilized as well as the individual sugars listed above. These corn syrups may yield a mix of sugar components for Z. It should be understood that it is by no means intended to exclude other suitable raw materials. Z preferably will be selected from the group consisting of $—CH_2—(CHOH)_n—CH_2OH$, $—CH(CH_2OH)—(CHOH)_{n-1}—CH_2OH$, $—CH_2—(CHOH)_2(CHOR')(CHOH)—CH_2OH$, where n is an integer from 3 to 5, inclusive, and R' is H or a cyclic or aliphatic monosaccharide, and alkoxylated derivatives thereof. Most preferred are glycityls wherein n is 4, particularly $—CH_2—(CHOH)_4—CH_2OH$.

In Formula (I), $R^1$ can be, for example, N-methyl, N-ethyl, N-propyl, N-isopropyl, N-butyl, N-2-hydroxy ethyl, or N-2-hydroxy propyl.

$R^2—CO—N<$ can be, for example, cocamide, stearamide, oleamide, lauramide, myristamide, capricamide, palmitamide, tallowamide, etc.

Z can be 1-deoxyglucityl, 2-deoxyfructityl, 1-deoxymaltityl, 1-deoxylactityl, 1-deoxygalactityl, 1-deoxymannityl, 1-deoxymaltotriotityl, etc.

Methods for making polyhydroxy fatty acid amides are known in the art. In general, they can be made by reacting an alkyl amine with a reducing sugar in a reductive amination reaction to form a corresponding N-alkyl polyhydroxyamine, and then reacting the N-alkyl polyhydroxyamine with a fatty aliphatic ester or triglyceride in a condensation/amidation step to form the N-alkyl, N-polyhydroxy fatty acid amide product. Processes for making compositions containing polyhydroxy fatty acid amides are disclosed, for example, in G.B. Patent Specification 809,060, published Feb. 18, 1959, by Thomas Hedley & Co., Ltd., U.S. Pat. No. 2,965,576, issued Dec. 20, 1960 to E. R. Wilson, and U.S. Pat. No. 2,703,798, Anthony M.

Schwartz, issued Mar. 8, 1955, U.S. Pat. No. 1,985,424, issued Dec. 25, 1934 to Piggott, U.S. Pat. No. 5,188,769, Connor et al, issued Feb. 23, 1993 and U.S. Pat. No. 5,194,639, Connor et al, issued Mar. 16, 1993, each of which is incorporated herein by reference.

pH of the Composition

Dishwashing compositions of the invention will be subjected to acidic stresses created by food soils when put to use, i.e., diluted and applied to soiled dishes. If a composition with a pH greater than 7 is to be more effective in improving performance, it should contain a buffering agent capable of maintaining the alkaline pH in the composition and in dilute solutions, i.e., about 0.1% to 0.4% by weight aqueous solution, of the composition. Light duty liquid or gel dishwashing detergent composition typically comprise a pH from about 7 to about 10; whereas automatic dishwashing detergent compositions comprise from about 8 to about 13 and laundry comprises from about 8 to about 13.

The buffering agent may be an active detergent in its own right, or it may be a low molecular weight, organic or inorganic material that is used in this composition solely for maintaining an alkaline pH. The buffering agent is present in the compositions of the invention hereof at a level of from about 0.1% to 15%, preferably from about 1% to 10%, most preferably from about 2% to 8%, by weight of the composition.

Calcium or Magnesium Ions

The presence of calcium and/or magnesium (divalent) ions improves the cleaning of greasy soils for various compositions, i.e. light duty liquid dishwashing detergent compositions containing alkyl ethoxy carboxylates and/or polyhydroxy fatty acid amide. This is especially true when the compositions are used in softened water that contains few divalent ions. It is believed that calcium and/or magnesium ions increase the packing of the surfactants at the oil/water interface, thereby reducing interfacial tension and improving grease cleaning.

Compositions of the invention hereof containing magnesium and/or calcium ions exhibit good grease removal, manifest mildness to the skin, and provide good storage stability. The ions are present in the compositions hereof at an active level of from about 0.1% to 4%, preferably from about 0.3% to 3.5%, more preferably from about 0.5% to 1%, by weight.

Preferably, the magnesium or calcium ions are added as a hydroxide, chloride, acetate, formate, oxide or nitrate salt to the compositions of the present invention.

The amount of calcium or magnesium ions present in compositions of the invention will be dependent upon the amount of total surfactant present therein, including the amount of alkyl ethoxy carboxylates and polyhydroxy fatty acid amide. When calcium ions are present in the compositions of this invention, the molar ratio of calcium ions to total anionic surfactant is from about 0.25:1 to about 2:1 for compositions of the invention.

Formulating such divalent ion-containing compositions in alkaline pH matrices may be difficult due to the incompatibility of the divalent ions, particularly magnesium, with hydroxide ions. When both divalent ions and alkaline pH are combined with the surfactant mixture of this invention, grease cleaning is achieved that is superior to that obtained by either alkaline pH or divalent ions alone. Yet, during storage, the stability of these compositions becomes poor due to the formation of hydroxide precipitates. Therefore, chelating agents discussed herein below may also be necessary.

Other Optional Components

In addition to the essential ingredients described hereinbefore, the compositions contain other conventional ingredients, especially those associated with dishwashing compositions.

Optional enzymes such as protease, lipase and/or amylase may be added to the compositions of the present invention for additional cleaning benefits, enzymes are highly desirable in automatic dishwashing detergents and laundry compositions. Enzyme stabilizing systems can also be added, such as calcium ion, boric acid, propylene glycol, short chain carboxylic acid, boronic acid and mixtures thereof. Preferred compositions comprise from about 0.01% to about 4.0% active enzyme.

Detergency builders can also be present in amounts from 0% to about 50%, preferably from about 2% to about 30%, most preferably from about 5% to about 15%. Detergency builders are especially desirable in laundry detergent and automatic dishwashing detergent compositions. Suitable detergency builders include but are not limited to the alkali metal, ammonium and alkanolammonium Salts of polyphosphates, phosphonates, phytic acid, silicates, carbonates, sulphates and aluminosilicates. Organic builders suitable for the purposes of the present invention include, but are not restricted to, a wide variety of polycarboxylate compounds. As used herein, "polycarboxylate" refers to compounds having a plurality of carboxylate groups, preferably at least 3 carboxylates. Polycarboxylate builder can generally be added to the composition in acid form but can also be added in the form of a neutralized salt.

It is typical in light duty liquid or gel dishwashing detergent compositions to have no detergent builder present. However, certain compositions containing magnesium or calcium ions may require the additional presence of low levels of, preferably from 0 to about 10%, more preferably from about 0.5% to about 3%, chelating agents selected from the group consisting of bicine/bis(2-ethanol)glycine), citrate N-(2-hydroxylethyl) iminodiacetic acid (I-IIDA), N-(2,3-dihydroxy-propyl) iminodiacetic acid (GIDA), and their alkali metal salts. Some of these chelating agents are also identified in the art as detergency builders.

The compositions of this invention may contain for chelating and detergency purposes from about 0.001% to about 15% of certain alkylpolyethoxypolycarboxlyate surfactants of the general formula $$R-O-(\underset{R_1}{CH}-\underset{R_2}{CH}-O)_x-R_3$$

wherein R is a $C_6$ to $C_{18}$ alkyl group, x ranges from about 1 to about 24, $R_1$ and $R_2$ are selected from the group consisting of hydrogen, methyl acid radical succinic acid radical hydroxy succinic acid radical, and mixtures thereof, wherein at least one $R_1$ or $R_2$ is a succinic acid and/or hydroxysuccinic acid radical and $R_3$ is hydrogen atom- An example of a commercially available alkylpolyethoxypolycarboxylate which can be employed in the present invention is POLY-TERGENT C, Olin Corporation, Cheshire, Conn.

The alkylpolyethoxypolycarboxylate surfactant is selected on the basis of its degree of hydrophilicity. A balance of carboxylation and ethoxylation is required in the alkylpolyethoxypolycarboxylate in order to achieve maximum chelating benefits without affecting the cleaning benefits which is associated with the divalent ions or the sudsing of the liquid or gel dishwashing detergent compositions. The number of carboxylate groups dictates the chelating ability, too much carboxylation will result in too strong a chelator and prevent cleaning by the divalent ions. A high degree of ethoxylation is desired for mildness and solubility; however, too high a level will affect sudsing. Therefore, an alkylpolyethoxypolycarboxylate with a modest degree of ethoxylation and minimal carboxylation is deskable.

Other desirable ingredients include diluents and solvents. Diluents can be inorganic salts, such as sodium sulfate, sodium chloride, sodium bicarbonate, etc., and the solvents include water, lower molecular weight alcohols such as ethyl alcohol, isopropyl alcohol, etc. Adding short-chain amine oxides, such as octyldimethylamine oxide, decyldimethylamine oxide, dodecylamine oxide and tetradecylamine oxide as solubilizing aids to the longer-chain amine oxide can be desirable. In liquid detergent compositions there will typically be from 0% to about 90%, preferably from about 20% to about 70%, most preferably from about 40% to about 60% of water, and from 0% to about 50%, most preferably from about 3% to about 10% of ingredients to promote solubility, including ethyl or isopropyl alcohol, conventional hydrotropes, etc.

Other conventional optional ingredients which are usually used in additive levels include opacifiers, antioxidants, bactericides, dyes, perfumes, optical brighteners, polymeric dispersants, polymeric soil release agents, clay soil removal/anti-redesposition agents, thickeners, bleach (i.e. chlorine and oxygen containing), suds suppressors and the like.

Method Aspect

In the method aspect of this invention, soiled dishes are contacted with an effective amount, typically from about 0.5 ml. to about 20 ml. (per 25 dishes being treated), preferably from about 3 ml. to about 10 ml., of the detergent composition of the present invention. The actual amount of liquid detergent composition used will be based on the judgment of user, and will typically depend upon factors such as the particular product formulation of the composition, including the concentration of active ingredient in the composition, the number of soiled dishes to be cleaned, the degree of soiling on the dishes, and the like. The particular product formulation, in turn, will depend upon a number of factors, such as the intended market (i.e., U.S., Europe, lapan, etc.) for the composition product. The following are examples of typical methods in which the detergent compositions of the present invention may be used to clean dishes. These examples are for illustrative purposes and are not intended to be limiting.

In a typical U.S. application, from about 3 ml. to about 15 ml., preferably from about 5 ml. to about 10 ml. of a liquid detergent composition is combined with from about 1,000 ml. to about 10,000 ml., more typically from about 3,000 ml. to about 5,000 ml. of water in a sink having a volumetric capacity in the range of from about 5,000 ml. to about 20,000 ml., more typically from about 10,000 ml. to about 15,000 ml. The detergent composition has a surfactant mixture concentration of from about 21% to about 44% by weight, preferably from about 25% to about 40% by weight. The soiled dishes are immersed in the sink containing the detergent composition and water, where they are cleaned by contacting the soiled surface of the dish with a cloth, sponge, or similar article. The cloth, sponge, or similar article may be immersed in the detergent composition and water mixture prior to being contacted with the dish surface, and is typically contacted with the dish surface for a period of time ranging from about 1 to about 10 seconds, although the actual time will vary with each application and user. The contacting of the cloth, sponge, or similar article to the dish surface is preferably accompanied by a concurrent scrubbing of the dish surface.

In a typical European market application, from about 3 ml. to about 15 ml., preferably from about 3 ml. to about 10 ml. of a liquid detergent composition is combined with from about 1,000 ml. to about 10,000 ml., more typically from about 3,000 ml. to about 5,000 ml. of water in a sink having a volumetric capacity in the range of from about 5,000 ml. to about 20,000 ml., more typically from about 10,000 ml. to about 15,000 ml. The detergent composition has a surfactant mixture concentration of from about 20% to about 50% by weight, preferably from about 30% to about 40%, by weight. The soiled dishes are immersed in the sink containing the detergent composition and water, where they are cleaned by contacting the soiled surface of the dish with a cloth, sponge, or similar article. The cloth, sponge, or similar article may be immersed in the detergent composition and water mixture prior to being contacted with the dish surface, and is typically contacted with the dish surface for a period of time ranging from about 1 to about 10 seconds, although the actual time will vary with each application and user. The contacting of the cloth, sponge, or similar article to the dish surface is preferably accompanied by a concurrent scrubbing of the dish surface.

In a typical Latin American and Japanese market application, from about 1 ml. to about 50 ml., preferably from about 2 ml. to about 10 ml. of a detergent composition is combined with from about 50 ml. to about 2,000 ml., more typically from about 100 ml. to about 1,000 ml. of water in a bowl having a volumetric capacity in the range of from about 500 ml. to about 5,000 ml., more typically from about 500 ml. to about 2,000 ml. The detergent composition has a surfactant mixture concentration of from about 5% to about 40% by weight, preferably from about 10% to about 30% by weight. The soiled dishes are cleaned by contacting the soiled surface of the dish with a cloth, sponge, or similar article. The cloth, sponge, or similar article may be immersed in the detergent composition and water mixture prior to being contacted with the dish surface, and is typically contacted with the dish surface for a period of time ranging from about 1 to about 10 seconds, although the actual time will vary with each application and user. The contacting of the cloth, sponge, or similar article to the dish surface is preferably accompanied by a concurrent scrubbing of the dish surface.

Another method of use will comprise immersing the soiled dishes into a water bath without any liquid dishwashing detergent. A device for absorbing liquid dishwashing detergent, such as a sponge, is placed directly into a separate quantity of undiluted liquid dishwashing composition for a period of time typically ranging from about 1 to about 5 seconds. The absorbing device, and consequently the undiluted liquid dishwashing composition, is then contacted individually to the surface of each of the soiled dishes to remove said soiling. The absorbing device is typically contacted with each dish surface for a period of time range from about 1 to about 10 seconds, although the actual time of application- will be dependent upon factors such as the degree of soiling of the dish. The contacting of the absorbing device to the dish surface is preferably accompanied by concurrent scrubbing.

A method for cleaning soiled tableware in an automatic dishwashing composition comprises contacting said tableware with an aqueous medium having a pH in the range from about 6 to about 11, more preferably from about 8 to about 10, and comprising at least about 1 ppm (part per million by weight) of an amine oxide as above described; said aqueous medium being formed by dissolving an automatic dishwashing detergent containing the essential amine oxide component in an automatic dishwashing machine.

GREASE REMOVAL

The "spontaneous emulsification" of greasy/oily soils provided by the compositions herein can be simply, but convincingly, demonstrated by admixing a detergent composition in accordance with the invention containing the specially selected soap with water. After dissolution of the detergent, a few drops of oil to which a colored off-soluble dye has been added are added to the detergent solution. With minimal agitation, the entire system appears to take on the color of the dye, due to the dyed oil having been finely dispersed by the spontaneous emulsification effect. This dispersion remains for a considerable length of time, typically 30 minutes to several hours, even when agitation has stopped. By contrast, with surfactant systems which fail to provide spontaneous emulsification, the dyed oil droplets produced during agitation rapidly coalesce to form one or more relatively large oil globules at the air/water interface.

More specifically, this demonstration of spontaneous emulsification can be run as follows.

A consumer relevant test soil is dyed with 0.5% Oil Red EGN. A 100 ml sample of the detergent composition being tested is prepared at the desired concentration (typically, about 500 ppm) and temperature in water which is "prehardened" to any desired concentration of calcium ions (typically, about 48 ppm), and contained in an 8 oz. capped jar. The sample pH is adjusted to the intended end-use pH (typically in the range of 6.5 to 8) and 0.2 g of the test soil is added. The jar is shaken 4 times and the sample graded. Alternatively, the sample is placed in a beaker and stirred with a stir bar for 15 seconds. The sample is graded as follows:

0=Clear solution with large red oil droplets in it (0.1–5 mm diameter), i.e., no emulsification;

1=Solution has a definite pink appearance with red oil droplets in it (0.1–1 mm), i.e., slight emulsification;

2=Solution is dark pink with small red droplets in it, i.e., moderate emulsification;

3=Solution is red with small red droplets in it (1–200 μm), i.e. emulsification is substantial;

4=Solution is dark red with little or no visible droplets (<1–50 μm), i.e., emulsification is complete.

Note: The grading can be done spectrophotometrically (based on light transmittance).

An alternate method for assessing grease removal performance is a determination of the amount of solid animal fat removed from polypropylene cups (PPC) under soil situation. Between 3 and 8 grams of animal fat is solidified onto the bottom of polypropylene cups and from about 0.2 to about 0.4% of the product is added. The % of fat removed after about 4 hours of storage is a gauge for the grease cleaning efficiency of the compositions.

As used herein, all percentages, parts, and ratios are by weight unless otherwise stated. The following Examples illustrate the invention and facilitate its understanding.

EXAMPLE I

Low sudsing detergent compositions are as follows:

| Ingredient | Composition A | B | C | D |
|---|---|---|---|---|
| | % by Weight | | | |
| $C_{12-13}$ Amine oxide | 22.5 | 22.5 | 26.7 | 30 |
| Alkylethoxy (1–3) carboxylate | 7.5 | 0 | 2.3 | 0 |
| Branched fatty acids | 0 | 7.5 | 2.0 | 2 |
| $Mg^{++}$ (added as hydroxide) | 0.6 | 0.6 | 0 | 0 |
| $Ca^{++}$ (added as formate) | 0 | 0.18 | 0 | 0.2 |
| $Ca^{++}$ (added as xylene sulfonate) | 0 | 0 | 0.18 | 0 |
| Triethanolamine 5 | 5 | 5 | 5 | |
| Diethylenetriamine penta acetate (40%) | 0.03 | 0.03 | 0.03 | 0.03 |
| Ethanol | 5 | 5 | 5 | 5 |
| Perfume | 0.18 | 0.18 | 0.18 | 0.18 |
| Protease | 0 | 0 | 0.05 | 0.30 |
| Water and other | balance | | | |

EXAMPLE II

Automatic dishwashing detergent compositions are as follows:

| Ingredient | Composition A | B | C | D |
|---|---|---|---|---|
| | % by Weight | | | |
| $C_{12-13}$ Amine oxide | 0.50 | 0.50 | 2.00 | 1.00 |
| Branched fatty acid | 0.10 | 0.10 | 0.40 | 0.20 |
| Nonionic surfactant $C_{22}E_8$ | 2.6 | 0 | 0 | 2 |
| STPP | 25 | 25 | 25 | — |
| Sodium carbonate | 23 | 23 | 23 | 20 |
| Liquid silicate | 18 | 18 | 18 | — |
| Sodium sulfate | 23 | 23 | 23 | 19 |
| Sodium DCC | 2 | 2 | 2 | 0 |
| Citrate | 0 | 0 | 0 | 18 |
| Savinase 6.0 T | 0 | 0 | 0 | 1.85 |
| Termermyl | 0 | 0 | 0 | 1.00 |
| Water and other | balance | | | |

EXAMPLE III

A granular laundry detergent for washing machines is shown below.

| | Wt. % |
|---|---|
| Sokalan CP5 (100% active as Na salt)[1] | 3.52 |
| Dequest 2066 (100% as acid) | 0.45 |
| Tinopal DMS[3] | 0.25 |
| Ca formate | 0.50 |
| Zeolite A | 17.9 |
| CMC | 0.45 |
| $Na_2CO_3$ | 9.4 |
| Citric acid | 3.5 |
| Layered silicate SKS-6 | 12.9 |
| $C_{18}$ sulfate | 2.8 |
| $C_{14-16}$ sulfate | 2.0 |
| $C_{12-15}$ alkyl ethoxy (3.0) sulfate | 1.0 |
| $C_{12-16}$ amine oxide | 10.0 |
| Branched fatty acid | 2.0 |
| Neodol $C_{18}E_9$ | 2.5 |
| Starch | 1.0 |
| Stearyl alcohol | 0.15 |
| Sodium percarbonate (coated) | 15 |

-continued

| | Wt. % |
|---|---|
| Tetraacetylenediamine (TAED) | 4.0 |
| Zinc phthalocyanin | 0.02 |
| Water and other | balance |

[1]Sokalan is sodium polyacrylate/maleate from Hoechst

EXAMPLE IV

A liquid laundry detergent composition herein comprises the following.

| Ingredient | % (Wt.) |
|---|---|
| Nonionic/anionic* | 5.0 |
| $C_{12-16}$ Amine oxide | 15.0 |
| 2-Butyl octanoic acid | 5.0 |
| Sodium citrate | 1.0 |
| $C_{10}$ Alcohol ethoxylate (3) | 13.0 |
| Monoethanolamine | 2.5 |
| Water/propylene glycol/ethanol (100:1) | Balance |

*1:1 mixture of cocoalkyl N-methyl glucamide and it sulfated counterpart surfactant.

EXAMPLE V

A granular detergent herein comprises the following.

| Ingredient | % (Wt.) |
|---|---|
| Nonionic/anionic* | 10.0 |
| $C_{12-16}$ Amine oxide | 10.0 |
| Zeolite A (1–10) micrometer) | 26.0 |
| 2-butyl octanoic acid | 4.0 |
| $C_{12-14}$ alkyl sulfate, Na salt | 5.0 |
| Sodium citrate | 5.0 |
| Sodium carbonate | 20.0 |
| Optical brightener | 0.1 |
| Detersive enzyme** | 1.0 |
| Sodium sulfate | 15.0 |
| Water and minors | Balance |

*1:1 mixture of tallow alkyl N-methyl glucamide and its sulfated counterpart surfactant, Na salt.
** Lipolytic enzyme preparation (LIPOLASE).

EXAMPLE VI

The compositions of Example I and II are modified by including 0.5% of a commercial proteolytic enzyme preparation (ESPERASE) therein. Optionally, 0.5% of a commercial amylase preparation (TERMAMYL), together with 0.5% of a commercial lipolytic enzyme preparation (LIPOLASE) can be co-incorporated in such liquid and solid detergent compositions.

What is claimed is:

1. An automatic dishwashing detergent composition consisting essentially of by weight:

(a) from about 0.1% to about 4.0% of a $C_{11-16}$ secondary soap;

(b) from about 0.5% to about 2% of a $C_{12-16}$ amine oxide;

(c) from about 0.1% to about 10% nonionic surfactant which does not foam selected from the group consisting of polyethylene, polypropylene, and polybutylene oxide condensates of alkyl phenols, condensation products of aliphatic alcohols with from about 1 to about 25 moles of ethylene oxide, condensation products of ethylene oxide with a hydrophobic base formed by the condensation of propylene oxide with propylene glycol; and mixtures thereof;

(d) from about 2% to about 30% of detergency builder selected from the groups consisting of phosphates, carboxylates, polycarboxylates and mixtures thereof; and (e) from about 0.01% to about 4% active protease enzyme, active amylase enzyme and mixtures thereof;

wherein said composition has a pH in a 0.1% to 0.4% water solution of between about 8 and about 13.

2. The composition of claim 1 wherein the pH is from about 11 to 13.

3. The composition of claim 1 wherein the composition further consists essentially of from about 2% to about 30% sodium carbonate.

4. The composition of any of claims 1, 2, and 3 wherein the level of amine oxide is from about 0.5% to 1%.

* * * * *